US006076750A

United States Patent [19]

Mykkänen et al.

[11] Patent Number: 6,076,750

[45] Date of Patent: Jun. 20, 2000

[54] DEVICE FOR FILLING PACKAGES

[75] Inventors: Ensio Mykkänen; Pertti Kleemola, both of Valkeakoski, Finland

[73] Assignee: UPM-Kymmene Oyj, Valkeakoski, Finland

[21] Appl. No.: 09/043,031

[22] PCT Filed: Oct. 18, 1996

[86] PCT No.: PCT/FI96/00551

§ 371 Date: Mar. 4, 1998

§ 102(e) Date: Mar. 4, 1998

[87] PCT Pub. No.: WO97/15493

PCT Pub. Date: May 1, 1997

[30] Foreign Application Priority Data

Oct. 27, 1995 [FI] Finland ..... 955122

[51] Int. Cl.[7] ..... B05B 1/30

[52] U.S. Cl. ..... 239/584; 239/104; 239/422; 239/433; 239/543; 239/562; 239/DIG. 19; 141/311 A; 141/392; 222/571

[58] Field of Search ..... 239/32, 104, 106, 239/119, 407, 418, 422, 428, 433, 543, 548, 566, 562, 597, 544, DIG. 19, 589, 558, 585.5, 533.1, 584; 222/485, 571, 559; 141/302, 311 A, 392

[56] References Cited

U.S. PATENT DOCUMENTS

| | | | |
|---|---|---|---|
| 1,250,222 | 12/1917 | Rahner | 239/32 |
| 2,927,737 | 3/1960 | Zeuch et al. | 239/584 X |
| 3,484,044 | 12/1969 | Dombruch et al. | 239/422 X |
| 4,262,848 | 4/1981 | Chabria | 239/422 X |
| 4,512,379 | 4/1985 | Hennig | 141/286 |
| 4,574,853 | 3/1986 | Graffin | 141/286 |
| 4,711,277 | 12/1987 | Clish | 141/311 |

FOREIGN PATENT DOCUMENTS

| | | | |
|---|---|---|---|
| 1098058 | of 1981 | Canada . | |
| 0 099 582 A2 | of 1984 | European Pat. Off. . | |
| 482591 | 4/1930 | Germany | 239/562 |
| 812 296 | of 1951 | Germany . | |
| 565299 | 11/1944 | United Kingdom | 239/584 |
| WO 95/26906 | of 1995 | WIPO . | |
| WO 96/39553 | of 1996 | WIPO . | |
| WO 96/41743 | of 1996 | WIPO . | |

*Primary Examiner*—Andres Kashnikow
*Assistant Examiner*—Steven J. Ganey
*Attorney, Agent, or Firm*—Pollock, Vande Sande & Amernick

[57] ABSTRACT

A device for filling containers, particularly packaging containers such as cardboard packaging containers, on the packaging container, comprises a feed part and a closing part. To prevent the dripping of the substance distributed into the packaging container on the area around the fill opening the feed part is equipped with outlets which form an angle with the center axis of the feed part so that the upper ends of the outlets separate from each other. In the lower end of the feed part, the angle position of the outlets causes the liquid flows from different outlets to unit into one flow of liquid which, if necessary, can be fed into a container even through a small fill opening.

16 Claims, 4 Drawing Sheets

DEVICE FOR FILLING PACKAGES

FIELD OF THE INVENTION

This invention relates to a device for filling containers, particularly packaging containers such as cardboard packaging containers, with fluid through a fill opening on the packaging container, the device comprising a feed part and a closing part.

BACKGROUND OF THE INVENTION

When using a conventional feeding device such as described above, a problem that often arises is that drops of liquid keep dripping from the feeding device even after it has been closed. These liquid drops can stain the exterior surfaces of the packaging container, and they can be particularly harmful to cardboard containers which are closed by placing a cover strip on top of the fill opening and by using heat sealing to attache the cover strip to the edges of the fill opening. If drops of the filled product have spilled on the edge area around the fill opening, heat sealing cannot be performed reliably. The reason for this is particularly that in heat sealing it is not possible to use a temperature high enough to evaporate the liquid drops which may be present at the sealing area.

SUMMARY OF THE INVENTION

The object of the present invention is to present a device for filling containers, particularly packaging containers such as cardboard packaging containers, which is absolutely reliable in preventing the access of the distributed substance to the exterior surface of the packaging container. This can be achieved with the help of a device according to the invention, comprising a feed part and a closing part, characterized in that the feed part is equipped with outlets which form an angle ($\alpha$) with the center axis of the feed part so that the upper ends of the outlets separate from each other.

A preferred embodiment of the device according to the invention for filling containers with fluid is thus created by equipping the feed part with outlets which form a specified angle ($\alpha$) with the center axis of the feed part so that the upper ends of the outlets separate from each other. This angle position which depends on the length of the feed part causes the upper ends of the outlets to separate from each other, thus enabling the reliable and smooth flow of the filled substance to all outlets. In the lower end of the feed part the angle position of the outlets causes the liquid flows from different outlets to unite into one flow which, if necessary, can be fed into a container even through a small fill opening. The benefits of the conical shape of the closing part include on the one hand that the size of the feed openings of the outlets increases thus encouraging the reliable and smooth flow of liquid, and on the other hand that the liquid flow can be easily stopped when closing the device which contributes to the non-dripping quality of the feed part. When the feed part is equipped with an adequate number of outlets to produce the necessary flow area, yet limiting the diameter of an individual outlet according to the substance to be distributed, a device for filling containers which meets very strict non-dripping requirements can be created.

BRIEF DESCRIPTION OF THE DRAWING

The present invention is described by the following example with reference to the attached drawing, wherein.

DETAILED DESCRIPTION OF PREFERRED EMBODIMENTS

Figure 1:
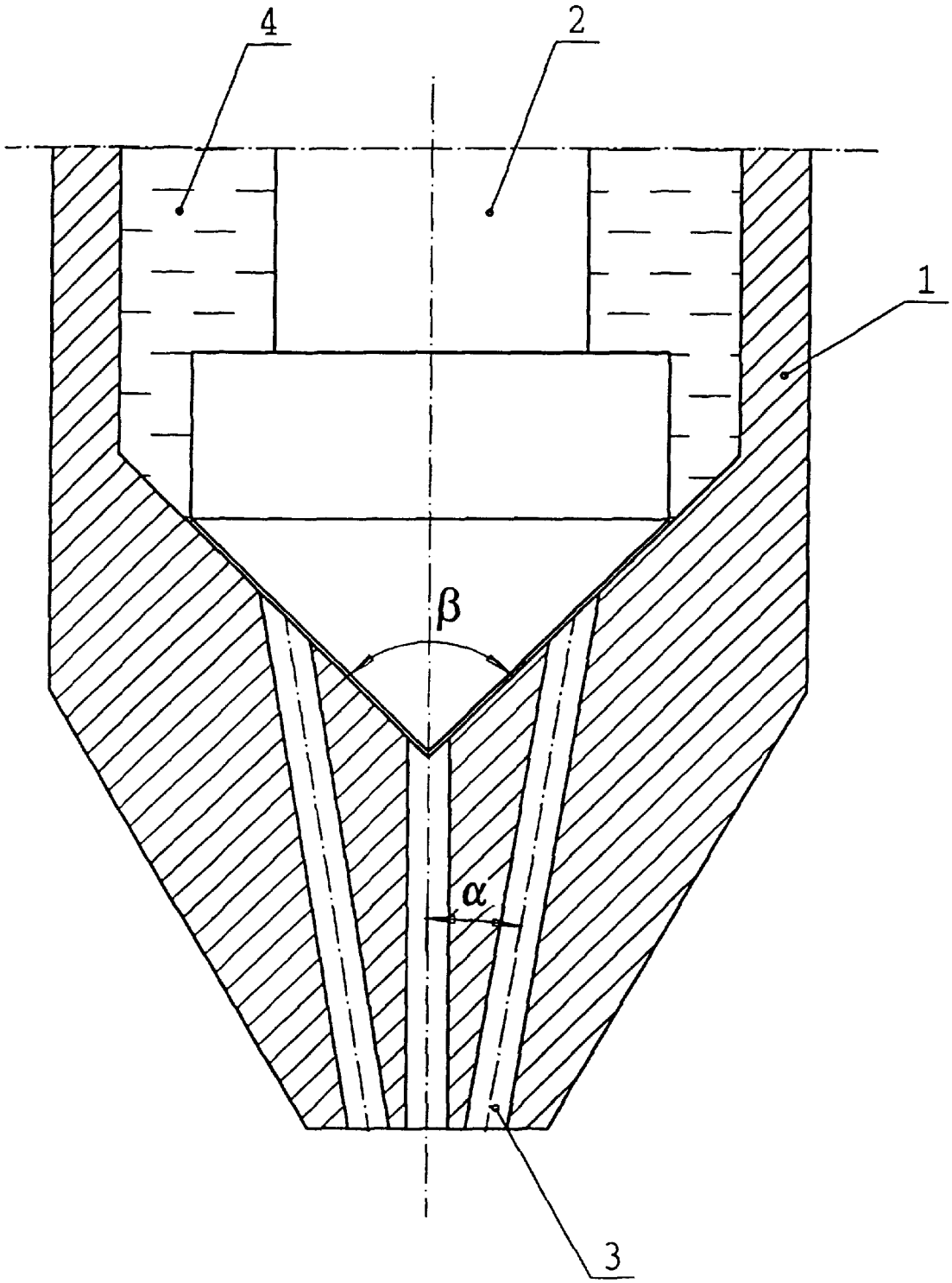
FIG. 1, shows a device according to the invention for filling containers.

FIG. 1 shows a device for filling containers, particularly packaging containers such as cardboard packaging containers, with fluid, the device comprising a feed part (1) and a closing part (2).

The device is opened by moving the closing part (2) upwards with respect to the feed part (1) so that the feed openings of the outlets (3) are released and the filled substance (4) lead to the feed part spreads to the outlets (3) and further out from the lower end of the feed part. The device is closed correspondingly by moving the closing part (2) downwards until the openings of the outlets (3) are closed by the closing part (2). By shaping the closing part (2) and the corresponding surface of the feed to be conical, the closing stage can be softened which will contribute to the realization of the non-dripping requirements. The conical shape also increases the size of the feed openings of the outlets (3) which contributes to reliable and smooth flow of liquid. Conical angle ($\beta$) may vary according to the circumstances from (20–180)°. Depending on the application, the material of the closing part can be made of relatively flexible and sterilizable material such as rubber, or relatively hard and sterilizable material such as plastic or stainless steel.

Figure 2:
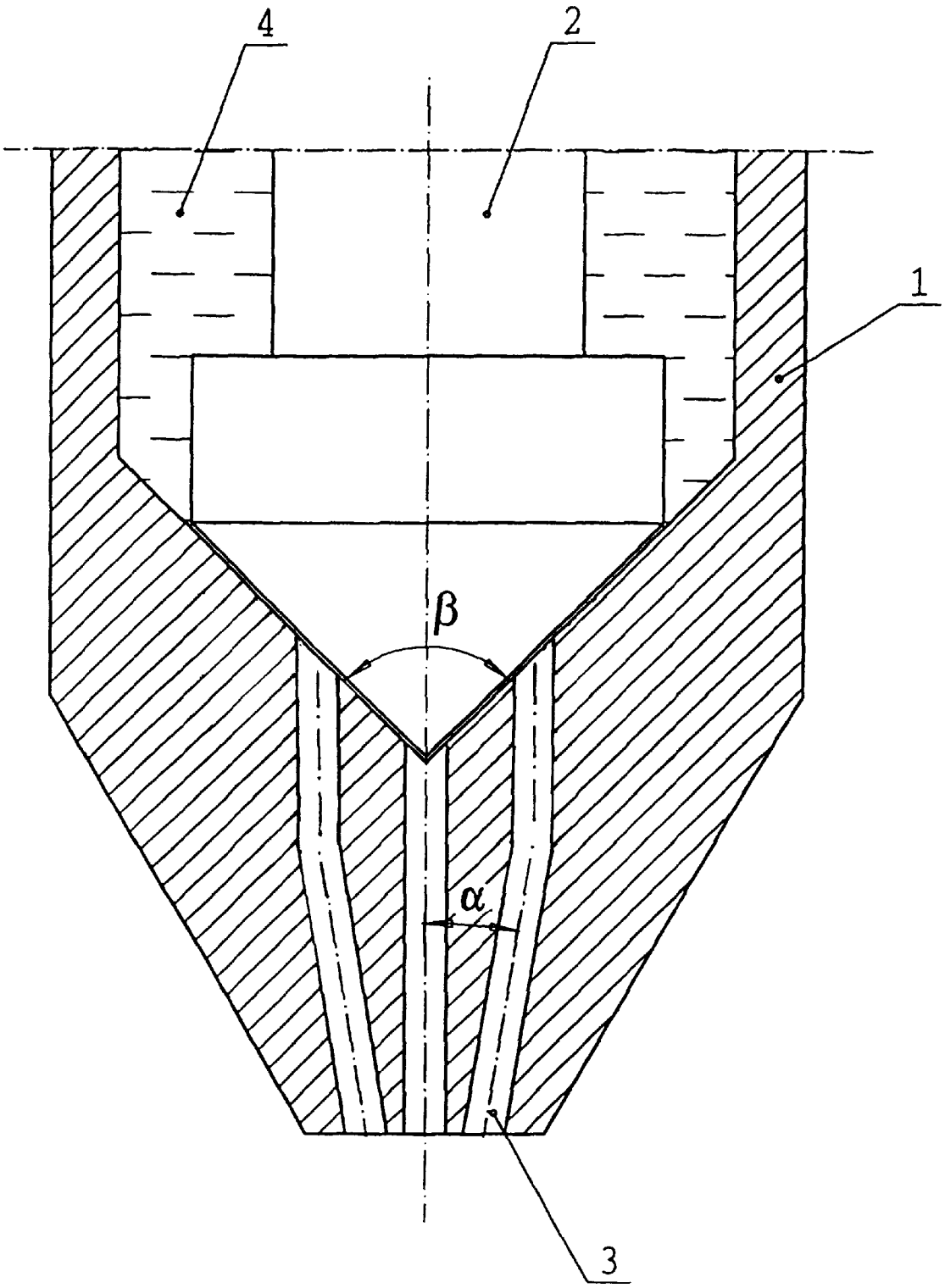
FIG. 2 shows an embodiment where a part of the length of the outlets is parallel to the center axis of the feed part.
Figure 3:
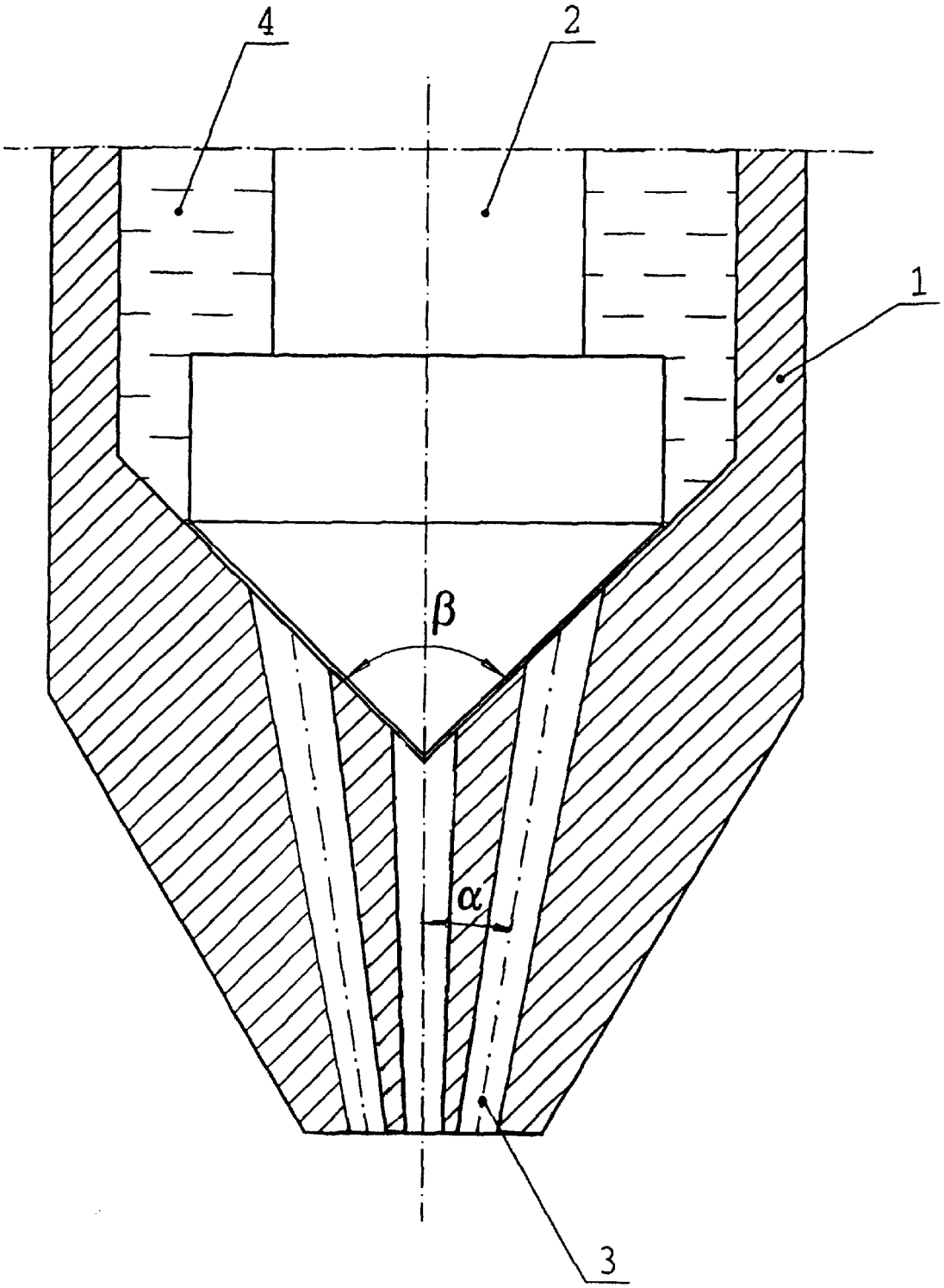
FIG. 3 shows an embodiment where the shape of the outlets is conical.
Figure 4:
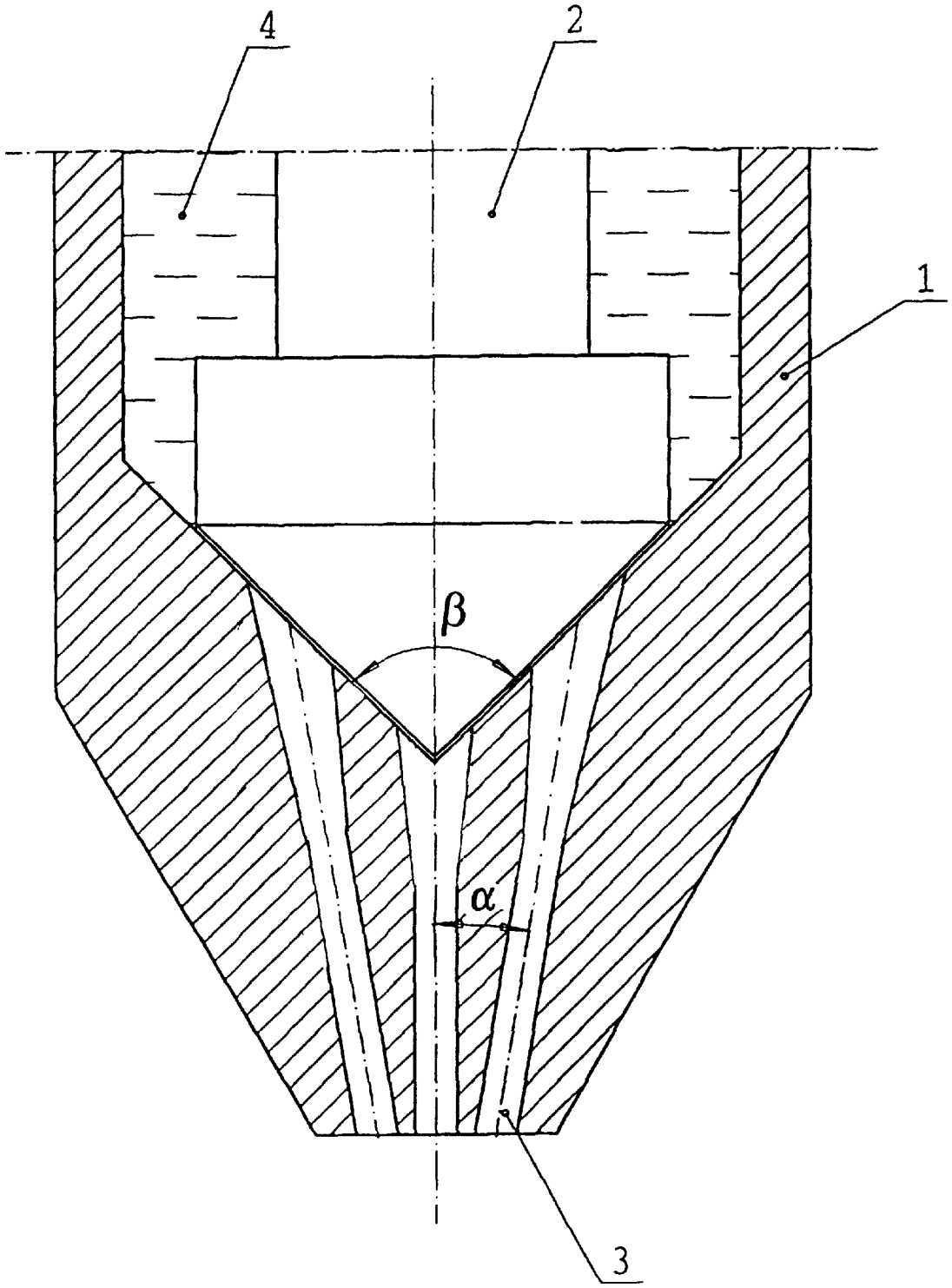
FIG. 4 shows an embodiment where the shape of the outlets is partly conical, partly cylindrical.

The feed part (1) is equipped with outlets (3) the diameter and number of which depends on the substance to be filled, since the non-dripping properties of an individual outlet and the entire device is based on the surface tension properties of the filled substance. The outlets (3) are preferably placed on the feed part (1) so that they form an angle ($\alpha$) with the center axis of the feed part (1). The advantage of this is that the upper ends of the outlets separate from each other thus making possible the reliable and smooth flow of liquid to all outlets. As a result of the angle position, in the lower end of the feed part the liquid flows from different outlets unite into one flow which, if necessary, can be fed into a container even through a small fill opening. Preferably one of the outlets can be placed essentially in the middle of the feed part (1) to ensure that the feed part runs empty, for example, in connection with washing. In one embodiment, a part of the length of the outlets (3) forms an angle ($\alpha$) with the center axis of the feed part (1) and a part runs parallel with the center axis of the feed part (1) as shown in FIG. 2. Depending on the circumstances the angle ($\alpha$) formed by the outlets (3) with the center axis of the feed part (1) can be (0.5–15)° and the minimum wall thickness between the outlets (3) in the lower end of the feed part (1) can be (0.1–2.0) mm. The combined cross-sectional area of the outlets (3) should be as large as possible when the maximum diameter of an outlet is 8.0 mm and the maximum number of outlets is 20. The shape of the outlets is preferably cylindrical but nevertheless they can also be shaped conical, or partly cylindrical and partly conical as shown in FIGS. 3 and 4. To enable the sterilization of the feed part (1) the material and the surface should preferably be of sterilizable quality.

What is claimed is:

1. A device for filling containers with fluid, the device comprising a feed part and a closing part, the feed part being equipped with outlets which are comprised of holes made in the feed part and open at their upper ends through openings to the same volume of fluid, the openings at the upper ends of the outlets being closable by the closing part, one outlet being placed essentially centrally in the feed part and essentially parallel with the center axis of the feed part, and the other outlets being placed around the essentially centrally situated outlet, and forming an angle with the center axis of the feed part so that the upper ends of the outlets separate from each other, and the outlets converge in the lower part of the feed part, and wherein a part of the length of the outlets forms an angle with the center axis of the feed part so that the upper ends of the outlets separate from each other, and a part of the length of the outlets is parallel to the center axis of the feed part.

2. A device according to claim 1, wherein the angle formed by the outlets with the center axis of the feed part is 0.5°–15° so that the upper ends of the outlets separate from each other.

3. A device according to claim 1, wherein the minimum wall thickness between the outlets in the lower end of the feed part is 0.1–2.0 mm.

4. A device according to claim 1, wherein the combined cross-sectional area of the outlets is as large as possible when the maximum diameter of an outlet is 8.0 mm.

5. A device according to claim 1, wherein the combined cross-sectional area of the outlets is as large as possible when the maximum number of outlets is 20.

6. A device according to claim 1, wherein the shape of the outlets is cylindrical.

7. A device according to claim 1, wherein the shape of the outlets is conical.

8. A device according to claim 1, wherein the shape of the outlets is partly conical, and partly cylindrical.

9. A device according to claim 1, wherein the feed part is made of a sterilizable material.

10. A device according to claim 1, wherein the smoothness of the feed part surface is of sterilizable quality.

11. A device according to claim 1, wherein the shape of the closing part is conical.

12. A device according to claim 1, wherein the conical angle of the feed part is in a range of 20°–180°.

13. A device according to claim 1, wherein the conical angle of the closing part is in a range of 20°–180°.

14. A device according to claim 1, wherein the material of the closing part is relatively flexible.

15. A device according to claim 1, wherein the material of the closing part is relatively unflexible.

16. A device according to claim 1, wherein the material of the closing part is sterilizable.

* * * * *